US007731479B2

(12) United States Patent
Chang et al.

(10) Patent No.: US 7,731,479 B2
(45) Date of Patent: Jun. 8, 2010

(54) FAN AND FAN HOUSING WITH AIRFLOW-GUIDING STATIONARY BLADES

(75) Inventors: Pei-Yu Chang, Taoyuan Hsien (TW); Tsu-Liang Lin, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 967 days.

(21) Appl. No.: 11/322,227

(22) Filed: Jan. 3, 2006

(65) Prior Publication Data

US 2007/0048129 A1 Mar. 1, 2007

(30) Foreign Application Priority Data

Aug. 24, 2005 (TW) ..... 94128839 A

(51) Int. Cl.
*F01D 9/00* (2006.01)

(52) U.S. Cl. ..... 415/191; 415/208.1; 415/211.2; 415/220; 415/221

(58) Field of Classification Search ..... 415/191, 415/208.1, 221.2, 220, 221
See application file for complete search history.

(56) References Cited

U.S. PATENT DOCUMENTS

| | | | | |
|---|---|---|---|---|
| 1,961,214 | A * | 6/1934 | Hall | 415/148 |
| 3,178,099 | A * | 4/1965 | Child | 415/119 |
| 5,310,309 | A * | 5/1994 | Terasaki et al. | 415/208.3 |
| 6,626,640 | B2 * | 9/2003 | Ivanovic | 415/142 |
| 6,910,862 | B2 * | 6/2005 | Horng et al. | 415/211.2 |
| 7,040,862 | B2 * | 5/2006 | Otsuka | 415/214.1 |
| 7,275,910 | B2 * | 10/2007 | Chang et al. | 415/211.2 |
| 2004/0265123 | A1 * | 12/2004 | Chang et al. | 415/211.2 |

* cited by examiner

*Primary Examiner*—Igor Kershteyn
(74) *Attorney, Agent, or Firm*—Birch, Stewart, Kolasch & Birch, LLP

(57) ABSTRACT

A fan includes a fan housing and an impeller. The fan housing includes a frame, a base disposed in the frame, a plurality of stationary blades disposed between the frame and the base, and a plurality of airflow-guiding elements extending inward from the frame and toward the base. The airflow-guiding elements and the stationary blades are alternately arranged. The impeller is disposed in the fan housing.

17 Claims, 5 Drawing Sheets

FAN AND FAN HOUSING WITH AIRFLOW-GUIDING STATIONARY BLADES

BACKGROUND OF THE INVENTION

1. Field of the Invention

The invention relates to a fan and a fan housing, and in particular relates to a fan and a fan housing provided with wing-shaped stationary blades and airflow-guiding elements.

2. Description of the Related Art

Referring to FIG. 1, a conventional axial fan housing 1 includes a frame 10, a base 11 disposed in the frame 10, and a plurality of stationary blades 12 disposed between the frame 10 and the base 11. During rotation of the fan blades (not shown, mounted in the fan housing 1), turbulent flow is generated at the airflow outlet of the fan housing 1. Thus, the airflow produced by the fan blades fails to effectively dissipate heat from a heat source. Such a situation is more serious particularly when the fan blades operate under high back pressure, wherein turbulent flow is generated along the curved surface of the stationary blade 12 as shown in FIG. 2. In this situation, the fan blades may lose speed, the airflow may fail to effectively do work, and excessive noise is generated.

BRIEF SUMMARY OF THE INVENTION

An object of the invention is to provide a fan and a fan housing having airflow-guiding stationary blades, wherein, between each two stationary blades, there is a wing-shaped airflow-guiding element extending inward from the fan housing. The airflow-guiding elements cooperate with the stationary blades so that the airflow passing through the stationary blades can do work again. Thus, the turbulent flow is restrained. The airflow smoothly passes through the curved surfaces of the stationary blades. The efficiency of heat-dissipation is improved. Furthermore, the airflow-guiding elements can prevent foreign matter from entering the fan housing so as to protect the inside elements thereof.

To achieve the above-mentioned object, the fan in accordance with an embodiment of the invention includes a fan housing and an impeller disposed in the fan housing. The fan housing includes a frame, a base disposed in the frame, a plurality of stationary blades disposed between the frame and the base, and a plurality of airflow-guiding elements extending inward from the frame and toward the base. The airflow-guiding elements are wing-shaped and spaced apart from the base. Alternatively, the airflow-guiding elements can extend outward from the base and toward the frame, and are spaced apart from the frame. Furthermore, the airflow-guiding elements are shaped to cooperate with the stationary blades so that the airflow passing through the stationary blades can do work again, thus restraining the turbulent flow. Furthermore, the airflow-guiding elements can prevent foreign matter from entering the fan housing so as to protect the inside elements thereof.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
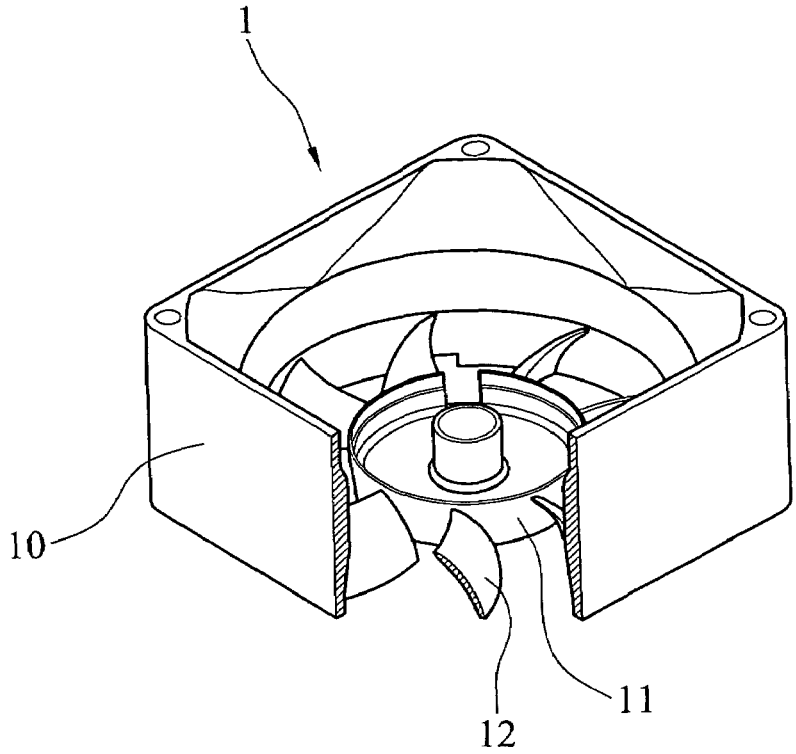
FIG. 1 ( RELATED ART )
FIG. 1 is a perspective diagram of a conventional axial fan housing with a part removed.
Figure 2:
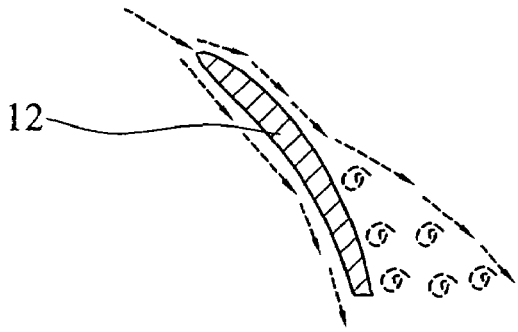
FIG. 2 ( RELATED ART )
FIG. 2 depicts a stationary blade of the conventional axial fan housing in a flow field.
Figure 3:
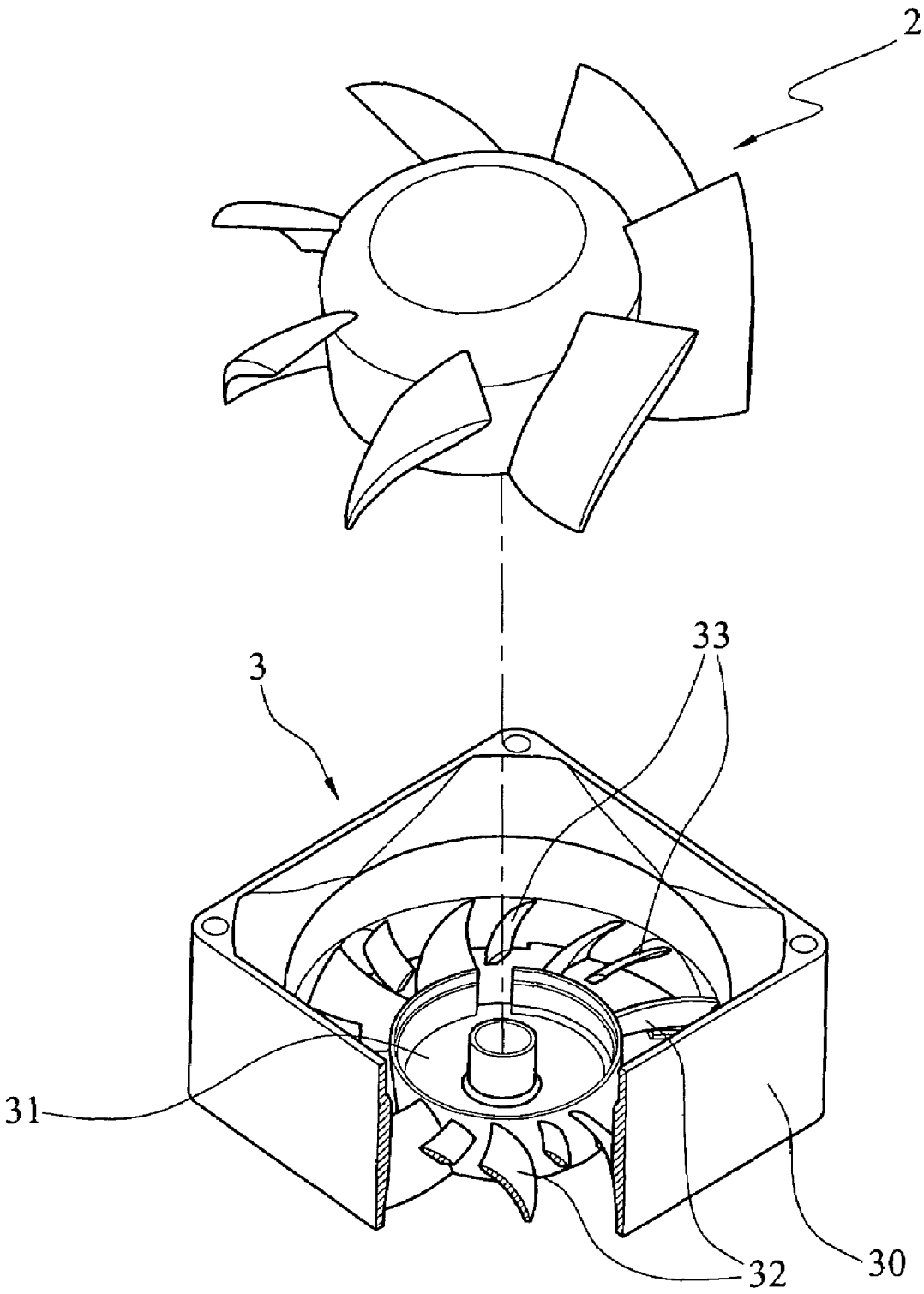
FIG. 3 is a perspective diagram of a fan in accordance with an embodiment of the invention, wherein the airflow-guiding elements extend inward from the upper part of the frame.

Referring to FIG. 3, a fan in accordance with an embodiment of the invention includes a fan housing 3 and an impeller 2 disposed in the fan housing 3. The impeller 2 includes a plurality of inclinedly upward-extending blades. The fan housing 3 includes a substantially square frame 30, a round base 31 disposed in the frame 30, a plurality of stationary blades 32 disposed between the frame 30 and the base 31, and a plurality of airflow-guiding elements 33 extending inward from the upper part of the frame 30 and toward the base 31. The stationary blades 32 and the airflow-guiding elements 33 are alternately arranged.

The stationary blades 32 and airflow-guiding elements 33 are wing-shaped. The airflow-guiding elements 33 are spaced apart from the base 31 to avoid a significant influence on the amount of airflow. Furthermore, the height of the airflow-guiding elements 33 ranges from a quarter to three quarters of that of the stationary blades 32.

Figure 4:
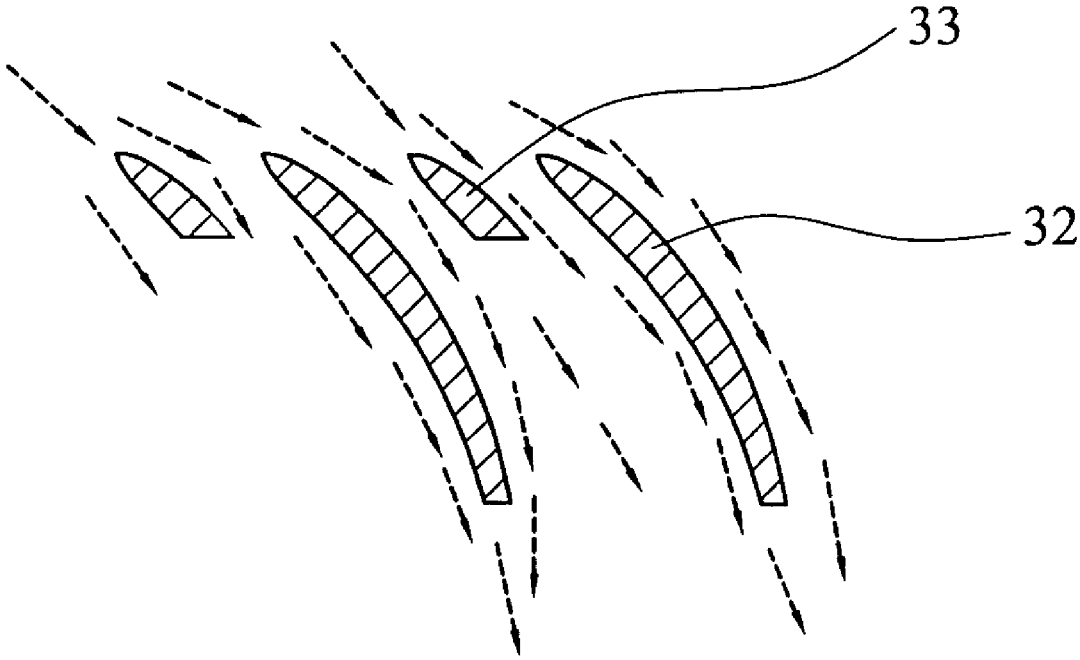
FIG. 4 depicts the stationary blades and airflow-guiding elements of FIG. 3 in a flow field.

Referring to FIG. 4, during rotation of the impeller 2, the airflow passes through the stationary blades 32 and the airflow-guiding elements 33 disposed beside the upper parts of the stationary blades 32. The airflow-guiding elements 33 have wing-shaped surfaces directing the airflow to the lower parts of the stationary blades 32, thereby restraining the turbulent flow at the airflow outlet of the fan housing 3 and on the curved surfaces of the stationary blades 32. Thus, noise arising from the turbulent flow is reduced. Moreover, the airflow-guiding elements 33 can prevent foreign matter from entering the fan housing 3 so as to protect the inside elements thereof.

Figure 5:
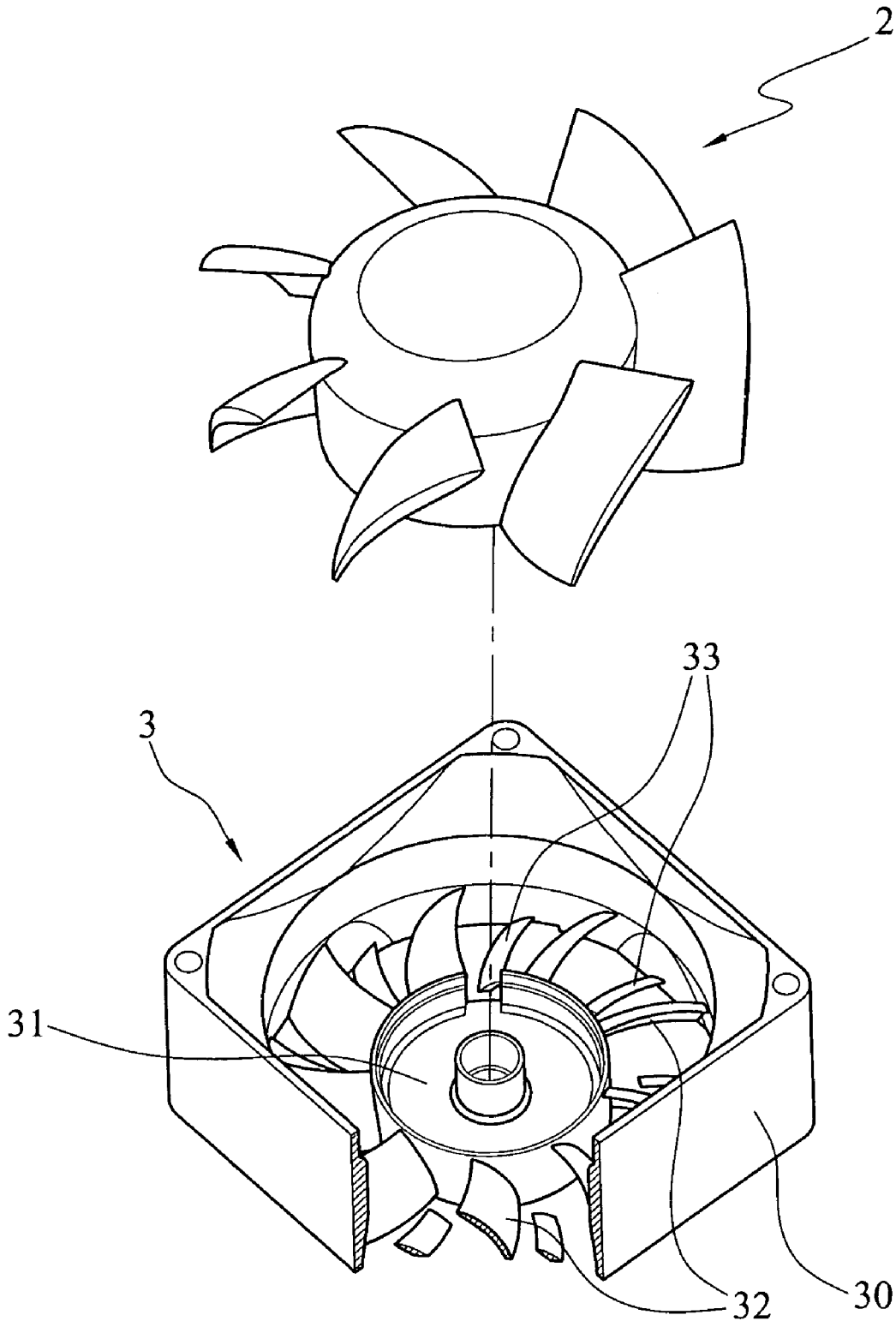
FIG. 5 is a perspective diagram of a fan in accordance with another embodiment of the invention, wherein the airflow-guiding elements extend inward from the lower part of the frame.

FIG. 5 depicts a fan in accordance with another embodiment of the invention, wherein all the elements and the structural connection therebetween are identical to those of the previous embodiment except that the airflow-guiding elements 33 extend inward from the lower part of the frame 3 and toward the base 31. Alternatively, the airflow-guiding elements 33 can extend outward from the upper or lower part of the base 31 and toward the frame 30, and are spaced apart from the frame 30.

Figure 6:
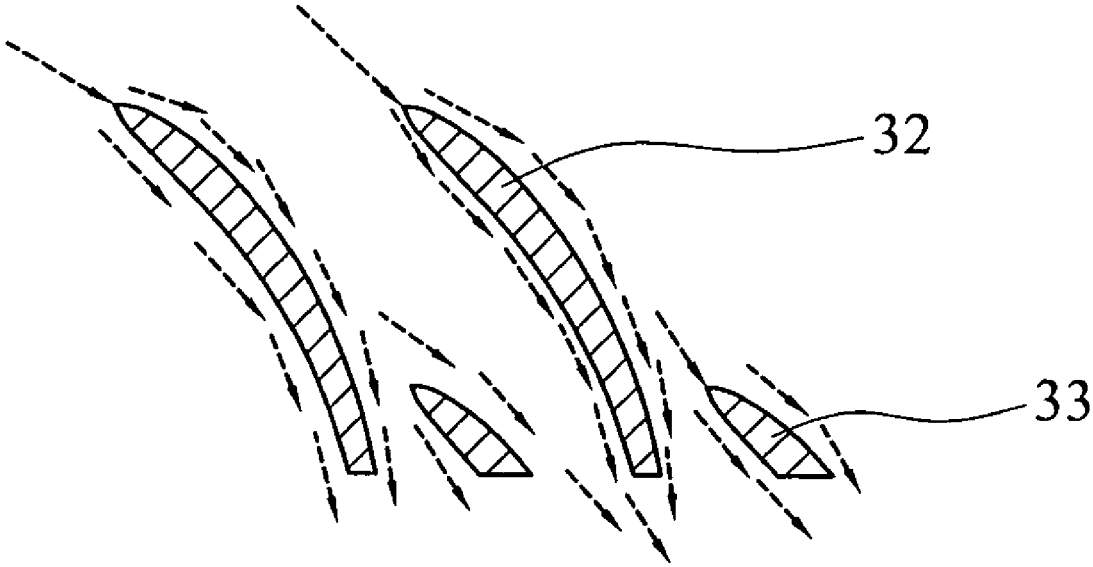
FIG. 6 depicts the stationary blades and airflow-guiding elements of FIG. 5 in a flow field.

Referring to FIG. 6, in this embodiment, the airflow passes through the stationary blades 32 and the airflow-guiding elements 33 disposed beside the lower parts of the stationary blades 32. Both the airflow-guiding elements 33 and the stationary blades 32 have wing-shaped surfaces restraining the turbulent flow and thus reducing the noise arising from the turbulent flow. Moreover, the airflow-guiding elements 33 can prevent foreign matter from entering the fan housing 3 so as to protect the inside elements thereof.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan housing, comprising:

a frame;

a base disposed in the frame;

a plurality of stationary blades disposed between the frame and the base;

a plurality of airflow-guiding elements disposed between the stationary blades, wherein the airflow-guiding elements are spaced apart from the base, and each of the airflow-guiding elements has one free end.

2. The fan housing as claimed in claim 1, wherein a height of the guiding-airflow elements in an axial direction ranges from a quarter to three quarters of that of the stationary blades.

3. The fan housing as claimed in claim 2, wherein the airflow-guiding elements extend inward from an upper part of the frame.

4. The fan housing as claimed in claim 2, wherein the airflow-guiding elements extend inward from a lower part of the frame.

5. The fan housing as claimed in claim 1, wherein the stationary blades and the airflow-guiding elements are wing-shaped.

6. A fan housing, comprising:

a frame;

a base disposed in the frame;

a plurality of stationary blades disposed between the frame and the base; and a plurality of airflow-guiding elements extending from the frame or the base, wherein each of the airflow-guiding elements has one free end, wherein the airflow-guiding elements and the stationary blades are alternately arranged.

7. The fan housing as claimed in claim 6, wherein the airflow-guiding elements and the stationary blades are wing-shaped.

8. The fan housing as claimed in claim 6, wherein a height of the airflow-guiding elements ranges from a quarter to three quarters of that of the stationary blades.

9. The fan housing as claimed in claim 8, wherein the airflow-guiding elements extend from an upper part of the frame or the base.

10. The fan housing as claimed in claim 8, wherein the airflow-guiding elements extend from a lower part of the frame or the base.

11. A fan, comprising:

a fan housing comprising:

a frame;

a base disposed in the frame;

a plurality of stationary blades disposed between the frame and the base; and a plurality of airflow-guiding elements extending from the frame or the base and disposed between the stationary blades, wherein each of the airflow-guiding elements has one free end; and an impeller disposed in the fan housing, wherein the airflow-guiding elements and the stationary blades are alternately arranged.

12. The fan as claimed in claim 11, wherein the airflow-guiding elements and the stationary blades are wing-shaped.

13. The fan as claimed in claim 11, wherein a height of the guiding-airflow elements ranges from a quarter to three quarters of that of the stationary blades.

14. The fan as claimed in claim 13, wherein the airflow-guiding elements extend from an upper part of the frame or the base.

15. The fan as claimed in claim 13, wherein the airflow-guiding elements extend from a lower part of the frame or the base.

16. The fan as claimed in claim 11, wherein the impeller comprises a plurality of inclinedly upward-extending, inclined blades.

17. A fan, comprising:

a fan housing comprising:

a frame;

a base disposed in the frame;

a plurality of stationary blades disposed between the frame and the base; and a plurality of airflow-guiding elements extending from the frame or the base, wherein each of the airflow-guiding elements has one free end; and an impeller disposed in the fan housing and comprising a plurality of inclinedly upward-extending, inclined blades;

wherein the airflow-guiding elements and the stationary blades are alternately arranged.

* * * * *